US010451227B2

(12) United States Patent
Hughes et al.

(10) Patent No.: US 10,451,227 B2
(45) Date of Patent: Oct. 22, 2019

(54) STRING LIGHT

(71) Applicant: ERICSON MANUFACTURING CO., Willoughby, OH (US)

(72) Inventors: Ronald W. Hughes, Thompson, OH (US); Jeffrey R. Angle, Newbury, OH (US); John Ericson, III, Willoughby, OH (US)

(73) Assignee: Ericson Manufacturing Co., Willoughby, OH (US)

( * ) Notice: Subject to any disclaimer, the term of this patent is extended or adjusted under 35 U.S.C. 154(b) by 732 days.

(21) Appl. No.: 15/009,259

(22) Filed: Jan. 28, 2016

(65) Prior Publication Data

US 2016/0215942 A1 Jul. 28, 2016

Related U.S. Application Data

(60) Provisional application No. 62/108,808, filed on Jan. 28, 2015.

(51) Int. Cl.

| | |
|---|---|
| ***F21S 4/10*** | (2016.01) |
| ***F21S 8/06*** | (2006.01) |
| ***F21V 21/005*** | (2006.01) |
| ***F21K 9/27*** | (2016.01) |
| *F21Y 103/00* | (2016.01) |

(52) U.S. Cl.

CPC ..... *F21S 4/10* (2016.01); *F21K 9/27* (2016.08); *F21S 8/06* (2013.01); *F21V 21/005* (2013.01); *F21Y 2103/00* (2013.01)

(58) Field of Classification Search

CPC ..... F21S 4/10; F21S 8/06; F21K 9/27; F21V 21/005; F21Y 2103/00

USPC ..... 362/249.06

See application file for complete search history.

(56) References Cited

U.S. PATENT DOCUMENTS

| | | | |
|---|---|---|---|
| 2,606,278 | A | 8/1952 | Smith |
| D280,025 | S | 8/1985 | Waters |
| D381,734 | S | 7/1997 | Murphy |
| D394,123 | S | 5/1998 | Yuen |
| 6,120,163 | A | 9/2000 | Graber et al. |
| 6,283,612 | B1 | 9/2001 | Hunter |
| D465,038 | S | 10/2002 | Bragg |
| 6,583,550 | B2 | 6/2003 | Iwasa |
| D521,676 | S | 5/2006 | Richner |
| 7,160,140 | B1 | 1/2007 | Mrakovich et al. |
| 7,165,863 | B1 | 1/2007 | Thomas et al. |
| 7,175,459 | B2 | 2/2007 | Miner |
| D582,851 | S | 12/2008 | Lavy |

(Continued)

*Primary Examiner* — Anh T Mai
*Assistant Examiner* — Jessica M Apenteng
(74) *Attorney, Agent, or Firm* — Calfee, Halter & Griswold LLP

(57) ABSTRACT

The present application discloses a string light assembly, such as for example, a string light assembly for task lighting in an industrial or transportation environment. In certain embodiments, an exemplary lighting device includes a length of electrical cable, at least one socket secured to the electrical cable, and at least one cover that encases the socket. The cover is secured to the electrical cable by placing the electrical cable in a through hole of the cover. In addition, the cover comprises a first connection port configured to receive an end of an electric lamp and a sloped surface that extends between a portion of the cover having the through hole and the connection port.

25 Claims, 7 Drawing Sheets

(56) References Cited

U.S. PATENT DOCUMENTS

| | | | | |
|---|---|---|---|---|
| 7,520,771 | B2 | 4/2009 | Nall et al. | |
| D595,411 | S | 6/2009 | Shimomura | |
| D601,090 | S | 9/2009 | Vigorito | |
| D603,078 | S | 10/2009 | Noh | |
| D675,117 | S | 1/2013 | Diefenderfer | |
| 8,376,576 | B2 | 1/2013 | Sloan et al. | |
| 8,474,129 | B2 | 7/2013 | Blocher et al. | |
| D696,812 | S * | 12/2013 | Peng | D26/76 |
| 8,632,207 | B2 | 1/2014 | Bowen | |
| D698,812 | S | 2/2014 | Gardner et al. | |
| 9,097,417 | B1 * | 8/2015 | Kwon | F21V 31/005 |
| 2008/0084702 | A1 | 4/2008 | Cheung | |
| 2010/0302773 | A1 | 12/2010 | Kokoski et al. | |
| 2012/0032587 | A1 | 2/2012 | Shih | |
| 2012/0188756 | A1 | 7/2012 | Kokoski et al. | |
| 2012/0236554 | A1 | 9/2012 | Rust | |
| 2013/0039067 | A1 | 2/2013 | Wong | |
| 2013/0201658 | A1 * | 8/2013 | Bogart | F21S 4/001<br>362/95 |
| 2013/0249394 | A1 | 9/2013 | Fay | |
| 2014/0036505 | A1 | 2/2014 | Barton | |
| 2014/0126194 | A1 * | 5/2014 | Matsuura | F21S 8/031<br>362/217.05 |
| 2014/0197748 | A1 | 7/2014 | Pan et al. | |
| 2015/0008832 | A1 | 8/2015 | Chou | |

* cited by examiner

STRING LIGHT

CROSS-REFERENCE TO RELATED APPLICATIONS

The present application claims the benefit of U.S. Provisional Application Ser. No. 62/108,808, filed on Jan. 28, 2015, the disclosure of which is incorporated by reference in its entirety.

BACKGROUND

Lights are often a requirement in many industrial and transportation settings. Specific examples which require string lights are refinery and shipyard settings. It is known in the art to use incandescent and fluorescent lamps in a string arrangement in these and other application environments.

SUMMARY

The present application discloses a string light assembly, such as for example, a string light assembly for task lighting in an industrial or transportation environment.

In certain embodiments, an exemplary lighting device includes a length of electrical cable, at least one socket secured to the electrical cable, and at least one cover that encases the socket. The cover is secured to the electrical cable by placing the electrical cable in a through hole of the cover. In addition, the cover comprises a first connection port configured to receive an end of an electric lamp and a sloped surface that extends between a portion of the cover having the through hole and the connection port.

Another exemplary lighting device includes a length of electrical cable, at least one socket secured along the length of electrical cable, and at least one pair of covers. The pairs of covers comprise a first cover and a second cover, and the length of electrical cable is placed in a first through hole of the first cover and a second through hole of the second cover so that the pair of covers is secured to the length of electrical cable. The first cover encases the socket and comprises a first connection port configured to receive a first end of an electric lamp. The second cover comprises a second connection port configured to receive a second end of an electric lamp. At least one of the first cover and the second cover comprises a sloped surface that extends inward toward the connection port from a bottom surface of a portion of the cover comprising the through hole.

An exemplary lighting assembly includes a length of electrical cable and a plurality of lighting devices attached at predetermined positions along the length of electrical cable. The length of electrical cable comprises a plug and an outlet. Each lighting device comprises at least one socket secured along the length of electrical cable and at least one pair of plastic overmold shells. The socket is oriented in a substantially parallel position relative to an axis of the electrical cable. The pair of plastic overmold shells comprise a first shell and a second shell. The length of electrical cable is placed in a first through hole of the first shell and a second through hole of the second shell so that the pair of plastic overmold shells are secured to the length of electrical cable. The first shell encases the socket and comprises a first connection port configured to receive a first end of an electric lamp. The second shell comprises a second connection port configured to receive a second end of an electric lamp. At least one of the first shell and the second shell comprises a sloped surface that extends inward toward the connection port from a bottom surface of a portion of the overmold shell comprising the through hole.

Further features and advantages of the invention will become apparent from the following detailed description.

BRIEF DESCRIPTION OF THE DRAWING

Features and advantages of the general inventive concepts will become apparent from the following detailed description made with reference to the accompanying drawings.

DETAILED DESCRIPTION

Figure 1:
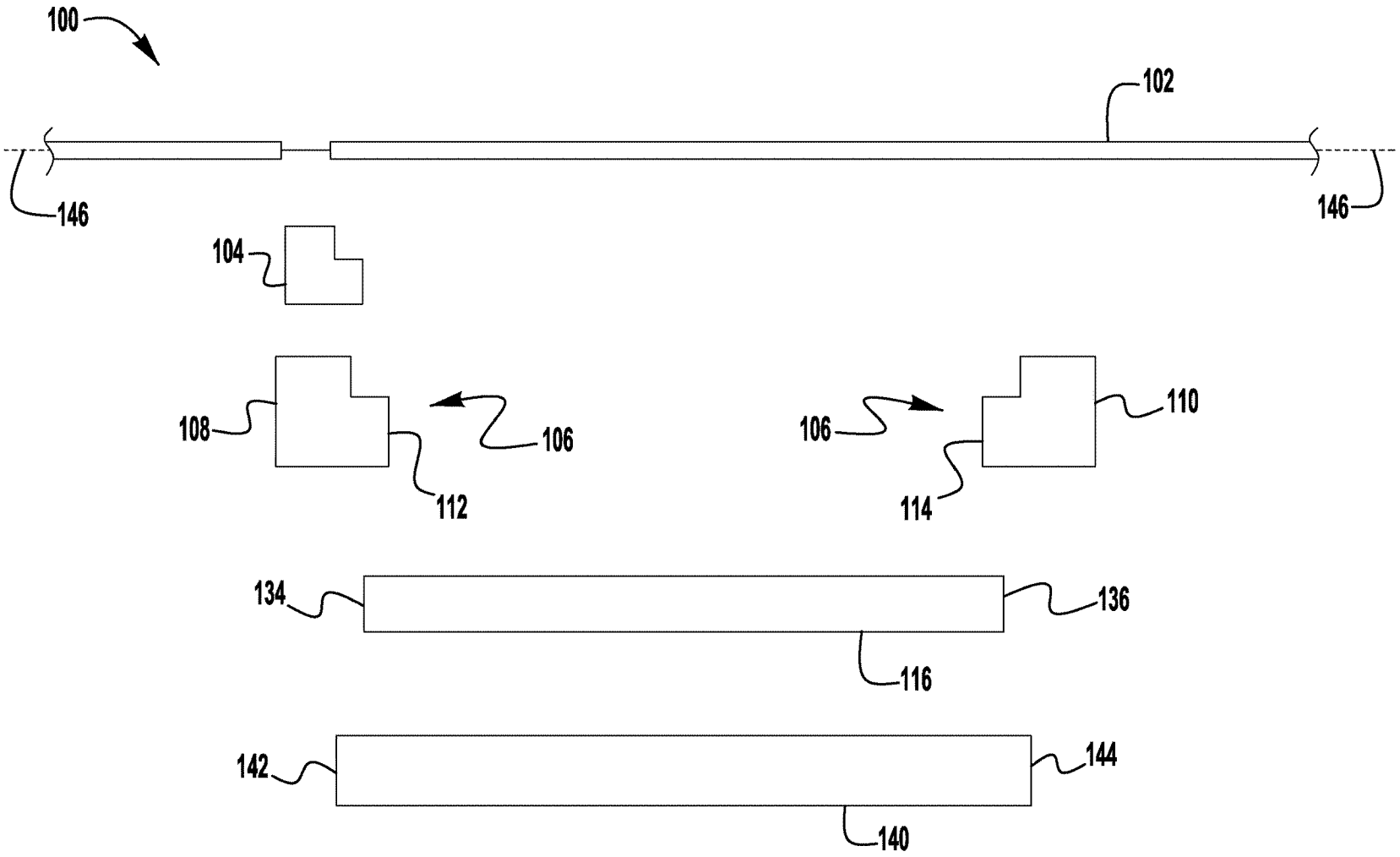
FIG. 1 is an exploded view of an exemplary lighting assembly with an electric lamp according to an embodiment of the present application.

This Detailed Description merely describes exemplary embodiments in accordance with the general inventive concepts and is not intended to limit the scope of the invention or the claims in any way. Indeed, the invention as described by the claims is broader than and unlimited by the exemplary embodiments set forth herein, and the terms used in the claims have their full ordinary meaning.

The terms "substantially" and "about" are defined as at least close to (and includes) a given value or state (preferably within 10% of, more preferably within 1% of, and most preferably within 0.1% of). The term "reasonable" means fair, sensible, or as conforming to or in agreement with sound engineering judgment.

"Non-standard electric lamp" indicates an electric lamp that is custom made. For example, a non-standard electric lamp may be any custom designed and manufactured lamp comprising a light-emitting diode (LED) or a fluorescent tube and separate drivers mounted to a heatsink for installation inside of a shield tube. Also, a non-standard electric lamp may include a slender aluminum heatsink folded into a triangular prism shape (e.g., shaped like a "Toblerone box") with electronic drivers inside and three rows of LED strips lengthwise down the outside surfaces, and it may be equipped with male pins on the end which would plug directly into a socket of a string light.

Lighting assemblies used in industrial and transportation settings often need to be fed or pulled through small openings. When the lighting assemblies are traveling through small openings, the lighting assembly may be knocked against hard objects (e.g., a wall) which could damage electric lamps in the lighting assembly, or the lighting assemblies may be too large to fit through some openings. A lighting assembly that is configured to easily fit through small openings is desirable. For example, lighting assemblies with electric lamps oriented horizontally reduces the height of the lighting assembly in comparison to current lighting assemblies, which allows the lighting assembly to fit through small openings. However, the reduction in height does not address the problem of electric lamps being damaged. The electric lamp could be covered to prevent damage, but covering the electric lamp may hinder the illumination of the electric lamp. Also, a cover can make the lighting assembly bulkier, which may prevent lamps from being fed or pulled through small openings. In addition, covers may include sharp edges that can get snagged on equipment or walls, thus preventing the lighting assembly from being fed or pulled through small openings. Another problem in industrial and transportation settings is that lighting assemblies take up space in rooms with low ceilings. As discussed above, lighting assemblies with electric lamps oriented horizontally reduces the height of the lighting assembly in comparison to current lighting assemblies, which is desirable in rooms with low ceilings.

Current lighting assemblies used in industrial and transportation settings often have screw-in lamps, such as, for example, incandescent lamps, compact fluorescent lamps (CFL), or LED lamps, which are often used in residential settings. As a result, these electric lamps are often stolen. Therefore, a lighting assembly for industrial and transportation settings that utilizes electric lamps that are not commonly used in residential settings is desirable (e.g., an elongated LED lamp).

Industrial and transportation settings vary in length. As a result, a lighting assembly that is a sufficient length in one setting, might be too short or too long for another setting. In order to use the same lighting assembly in different settings, it is desirable to have a lighting assembly that is able to be extended or retracted to fit in different settings.

The general inventive concepts will now be described with occasional reference to the exemplary embodiments of the invention. This general inventive concept may, however, be embodied in different forms and should not be construed as limited to the embodiments set forth herein. Rather, these embodiments are provided so that this disclosure will be thorough and complete, and will fully convey the scope of the general inventive concepts to those skilled in the art. While the exemplary embodiments of the present invention describe a lighting assembly having elongated LED lamps, it should be understood that the inventive concepts described herein can be utilized in lighting assemblies having other types of electric lamps, such as, for example, fluorescent lamps, CFL, incandescent lamps, non-standard electric lamps, or any other lighting technology that can be manufactured in a generally tubular, elongated shape.

FIG. 1 is an exploded view of an exemplary lighting device 100 having a length of electrical cable 102, a socket 104, and a pair of covers 106. The electrical cable 102 may have one or more sockets 104 and one or more pairs of covers 106 secured along its length. Each pair of covers 106 includes a first cover 108 and a second cover 110. The first cover 108 encases the socket 104 and has a first connection port 112 for receiving a first end 134 of an electric lamp 116. The first end 134 of the electric lamp 116 may be electrically coupled to the socket 104 in the first connection port 112. The second cover 110 has a second connection port 114 for receiving a second end 136 of the electric lamp 116. In certain embodiments, the second cover 110 may encase a second socket (not shown), if the electric lamp 116 requires an electrical connection to a socket at both ends of the electric lamp 116. In one embodiment, the first cover 108 and the second cover 110 may be plastic overmold shells. In another embodiment, the first cover 108 and the second cover 110 may be mechanically assembled covers, such as, for example, a multiple component cover including a snap fit, a clip, fasteners, or the like. In yet another embodiment, the first cover 108 and the second cover 110 may be a unitary cover that slide fits onto an electrical cable 102. The first cover 108 and the second cover 110 may be made of injection molded thermoplastic elastomer (TPE), injection molded thermoplastic vulcanite (TPV), injection molded silicone rubber (SIR), injection molded Styrene-Butadiene-Styrene (SBS), or the like. Alternatively, the first cover 108 and the second cover 110 may be made of compression molded rubbers, such as, for example, vinyl nitrile, chloroprene, or ethylene propylene diene monomer (EPDM). In one embodiment, a shield tube 140 covers and protects electric lamp 116. A first end 142 of the shield tube 140 is secured in the first connection port 112, and the second end 144 of the shield tube 140 is secured in the second connection port 114. In an exemplary embodiment, the first cover 108 and the second cover 110 are oriented so that the electric lamp 116 is outside of and in a substantially parallel position to a horizontal axis 146 of the electrical cable 102. In the embodiment including the shield tube 140, the shield tube 140 is outside of and in a substantially parallel position to a horizontal axis 146 of the electrical cable 102. The electric lamp 116 may be an LED lamp, a fluorescent lamp, a CFL, an incandescent lamps, a non-standard electric lamp, or any other lighting technology that can be manufactured in a generally tubular, elongated shape. In one embodiment, the electric lamps 116 are connected in parallel and run at the line voltage of the electric cable 102. Accordingly, if one electric lamp 116 fails or is removed from the socket 104, the other electric lamps are unaffected and continue to receive power.

In another exemplary embodiment, the lighting device 100 may include a length of electrical cable 102, a socket 104, and only a first cover 108. The lighting device 100 may have one or more sockets 104 and one or more first covers 108 secured along its length. The first cover 108 encases the socket 104. In addition, the first cover 108 has a first connection port 112 for receiving a first end 134 of an electric lamp 116. The first end 134 of the electric lamp 116 may be electrically coupled to the socket 104 in first connection port 112. In this embodiment, the second end 136 of the electric lamp 116 is not connected to a socket, and power is provided to the electric lamp 116 by only the socket 104 encased by the first cover 108.

Figure 2:
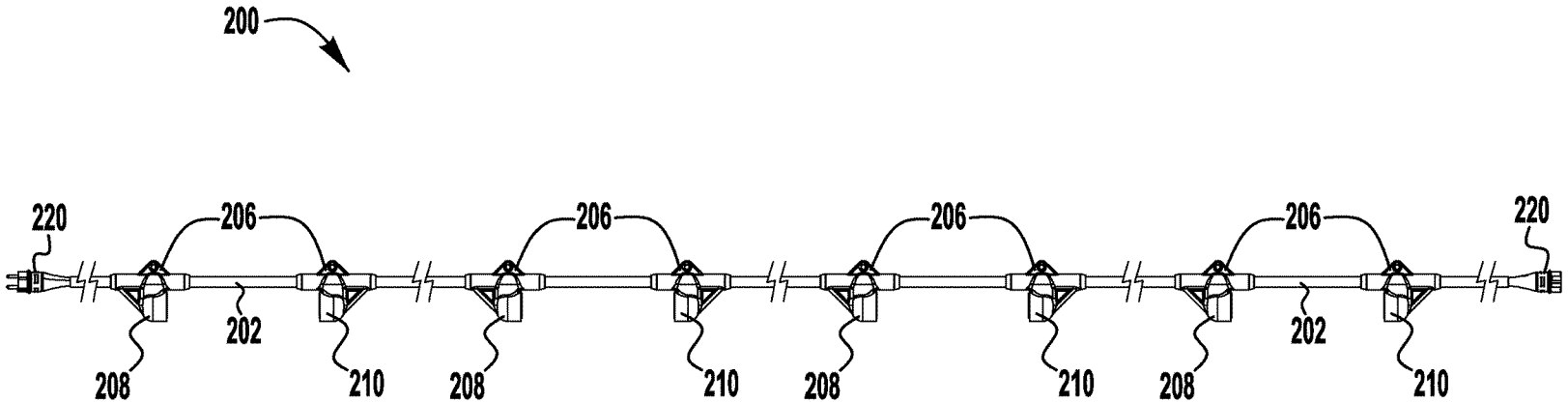
FIG. 2 is a front view of another exemplary lighting assembly without an electric lamp installed according to an embodiment of the present application.

FIG. 2 is another exemplary lighting device 200 including a length of electrical cable 202, one or more pairs of overmolded covers 206, one or more sockets 404 (FIGS. 4A and 4B), and electrical connections 220. Electrical connections 220 include a plug and an outlet. The sockets 404 are secured along the electrical cable 202. In certain embodiments, the sockets 404 are oriented in a substantially parallel position relative to the electrical cable 202, as shown in the illustrated embodiment. In one exemplary embodiment, the sockets 404 are secured at predetermined positions along the electrical cable 202. The pairs of overmolded covers 206 each include a first cover 208 and a second cover 210. The first cover 208 is secured along the electrical cable 202 by through hole 526 (FIG. 5), encases socket 404, and has a first connection port 512 (FIG. 5) for receiving a first end 534

Figure 3:
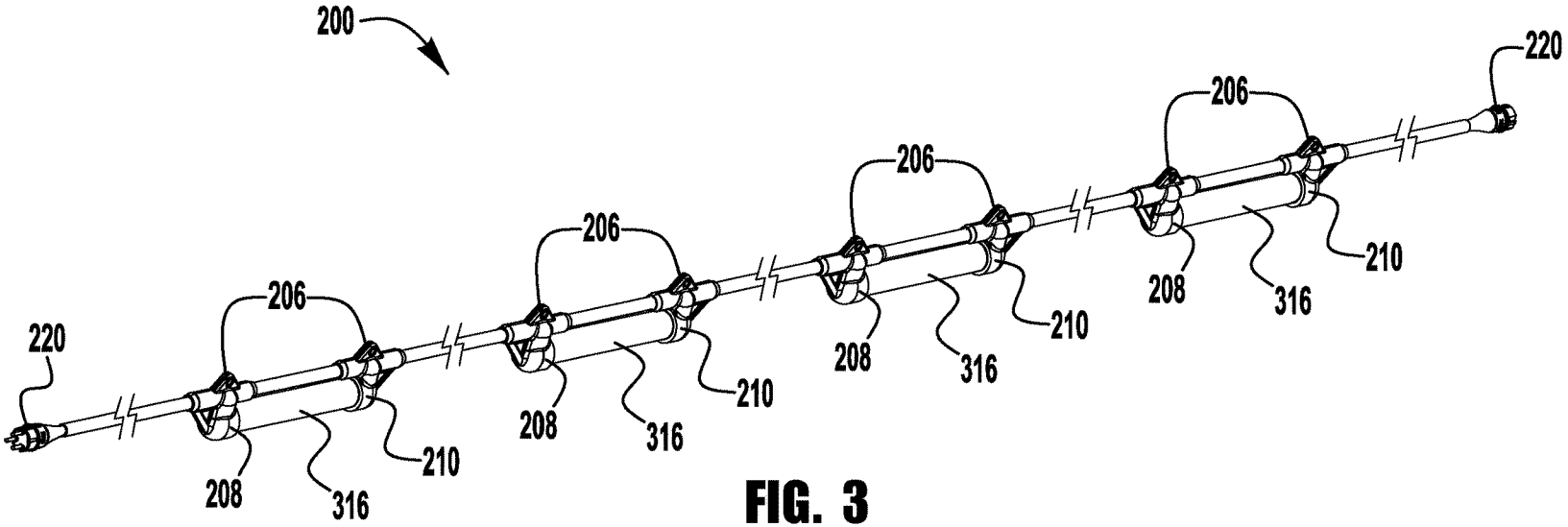
FIG. 3 is a perspective view of the exemplary lighting assembly of FIG. 2 with electric lamps installed according to an embodiment of the present application.

(FIG. 5) of an electric lamp 316 (FIG. 3). The second cover 210 is secured along the electrical cable 202 by through hole 528 (FIG. 5) and has a second connection port 514 (FIG. 5) for receiving a second end 536 (FIG. 5) of the electric lamp 316. In certain embodiments, the second cover 210 may encase a second socket (not shown), if the electric lamp 316 requires a connection to a socket at both ends. The electric lamp 116 may be an LED lamp, a fluorescent lamp, a CFL, an incandescent lamps, a non-standard electric lamp, or any other lighting technology that can be manufactured in a generally tubular, elongated shape.

The manufacturing of the lighting device 200 may be done at essentially any reasonable electrical cable length with any reasonable number of sockets 404 and any number of pairs of covers 206. In one embodiments, the covers 206 may be plastic overmold shells. In another embodiment, the covers 206 may be mechanically assembled covers, such as, for example, a multiple component cover including a snap fit, a clip, fasteners, or the like. In yet another embodiment, the covers 206 may be unitary covers that slide fit onto an electrical cable 202. In the embodiment in which the covers 206 are plastic overmold shells, the manufacturing process is done by a conventional overmolding technique, that is to say, the electrical cable 202 is cut to a predetermined length, the wire is stripped at predetermined location along the length of the electrical cable 202, sockets 404 are installed, and then an overmolding is preformed to form the overmolded covers 206. In some embodiments, the covers 206 may be made of injection molded TPE, injection molded TPV, injection molded SIR, injection molded SBS, or the like. Alternatively, the covers 206 may be made of compression molded rubbers, such as, for example, vinyl nitrile, chloroprene, or EPDM.

FIG. 3 is a perspective view of the exemplary lighting device 200 of FIG. 2 with electric lamps 316 installed. In one embodiment, the electric lamps 316 are installed in lighting device 200 such that the electric lamps are oriented in a substantially parallel position relative to the electrical cable 202, as shown in FIG. 3. The exemplary embodiment provided in FIG. 3 reduces the height of the lighting device 200 in comparison to current lighting devices. This reduction in height allows the lighting device 200 to fit through small openings. In addition, the reduction in height of the lighting device 200 is preferable for rooms or areas that have low ceilings or smaller clearances.

Figure 4A:
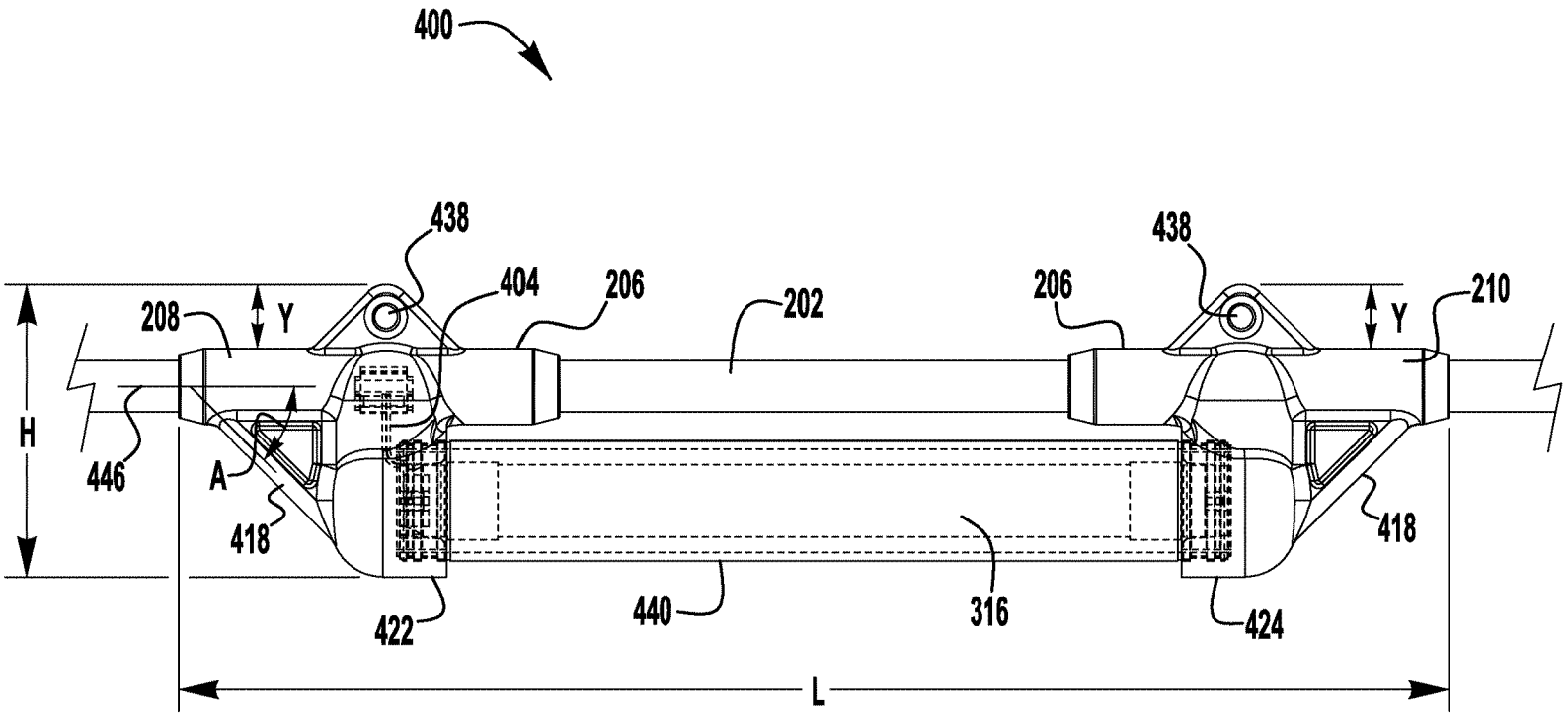
FIG. 4A is a front view of an exemplary light fixture of the exemplary lighting assembly of FIG. 2 with an elongated LED lamp installed according to an embodiment of the present application.
Figure 5:
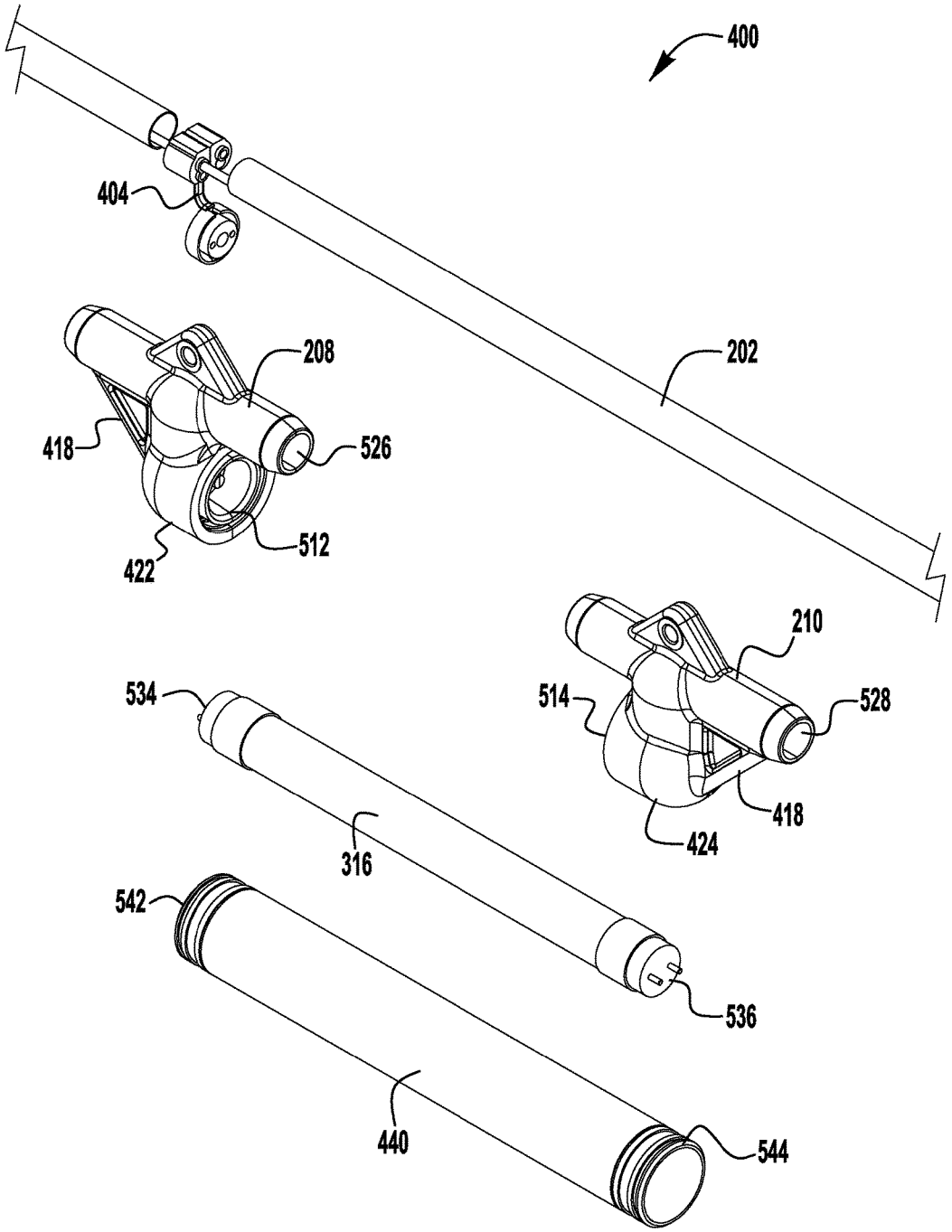
FIG. 5 is an exploded view of the exemplary lighting fixture shown of FIGS. 4A and 4B including the elongated LED lamp according to an embodiment of the present application.

FIG. 4A is an illustration of an exemplary light fixture 400 of the exemplary lighting device 200 of FIG. 2 with an elongated LED lamp 316 installed. However, any type of electric lamp disclosed in the present application may be installed in light fixture 400. The light fixture 400 is secured along the length of electrical cable 202 and includes one pair of covers 206 and one socket 404. Lighting device 200 may include one or more light fixtures 400 along the length of electrical cable 202. At least one of the pair of covers 206 includes a sloped surface 418. In certain embodiments, the sloped surface 418 of the first cover 208 may extend inward toward the connection port 512 (FIG. 5) from a bottom surface of the portion of the first cover 208 having the through hole 526 (FIG. 5). Similarly, the sloped surface 418 of the second cover 210 may extend inward toward the connection port 514 (FIG. 5) from a bottom surface of the portion of the second cover 210 having the through hole 528 (FIG. 5). In one embodiment, the angle A between the horizontal axis 446 of the through hole 526 and the sloped surface 418 may be between about 30 degrees and about 60 degrees. In another embodiment, the angle A between the horizontal axis 446 of the through hole 526 and the sloped surface 418 may be about 43 degrees. The height H of light fixture 400 may be between about 1 inch and about 6 inches. In another embodiment, the height H may be about 4.22 inches. In certain embodiments, the height H of the light fixture 400 may not include the distance Y of the member having hanger hole 438. In one embodiment, the distance Y may be between 0.5 inches and about 1.5 inches. In another embodiment, the distance Y may be about 0.92 inches. The sloped surface 418 and small height H (with or without distance Y) of the light fixture 400 allows the lighting device 200 to travel through an industrial or transportation setting, and specifically through small openings within a industrial or transportation setting, without getting snagged on objects, such as for example, walls or equipment. Also, a smaller height H of the light fixture 400 is preferable for rooms or areas that have low ceilings or smaller clearances. The length L of light fixture 400 may vary depending on the length of the electric lamp 316 that is being utilized. In certain embodiments, the length of the electric lamp 316 may be between about 6 inches and about 72 inches, For example, the length of the electric lamp may be one of 12 inches, 24 inches, 36 inches, 48 inches, or 60 inches. In certain embodiments, the length L of the light fixture 400 may be between about 12 inches and about 78 inches. In other embodiments, the length L of the light fixture 400 may be at least one of about 18 inches, 30 inches, 42 inches, 54 inches, or 66 inches.

The pair of covers 206 includes a first cover 208 and a second cover 210. The first cover 208 encases the socket 404 and has a first connection port 512 (FIG. 5) for receiving a first end 534 (FIG. 5) of the elongated LED lamp 316. The second cover has a second connection port 514 (FIG. 5) for receiving a second end 536 (FIG. 5) of the elongated LED lamp 316. In one embodiment, a shield tube 440 covers and protects electric lamp 316. A first end 542 (FIG. 5) of the shield tube 440 is secured in the first connection port 512, and the second end 544 (FIG. 5) of the shield tube 440 is secured in the second connection port 514. In an exemplary embodiment, the first cover 208 and the second cover 210 are oriented so that the electric lamp 316 is outside of and in a substantially parallel position to a horizontal axis 446 of the through hole 526 (FIG. 5) the first cover 208. In the embodiment including the shield tube 440, the shield tube 440 is outside of and in a substantially parallel position to the horizontal axis 446 of the through hole 526 the first cover 208.

In the illustrated embodiment shown in FIG. 4A, because the electric lamp is an elongated LED lamp 316, only the first end 534 of the elongated LED lamp 316 is connected to a socket 404. In other embodiments, both ends of the elongated LED lamp 316 may be connected to a socket 404, which would require the second cover 210 to encase a second socket (not shown). In another embodiment, an electric lamp other than an elongated LED lamp 316 may be installed (e.g., any electric lamp disclosed in the present application), and the electric lamp may require a second socket (not shown) encased by the second cover 210 to provide power to the electric lamp. In the embodiment illustrated in FIG. 4A, the elongated LED lamp 316 is electrically coupled to the socket 404 in the first connection port 512, which provides power to the elongated LED lamp 316 because the two power pins (not shown) are both located on the first end 534 of the elongated LED lamp 316 and connected to the socket 404.

Figure 4B:
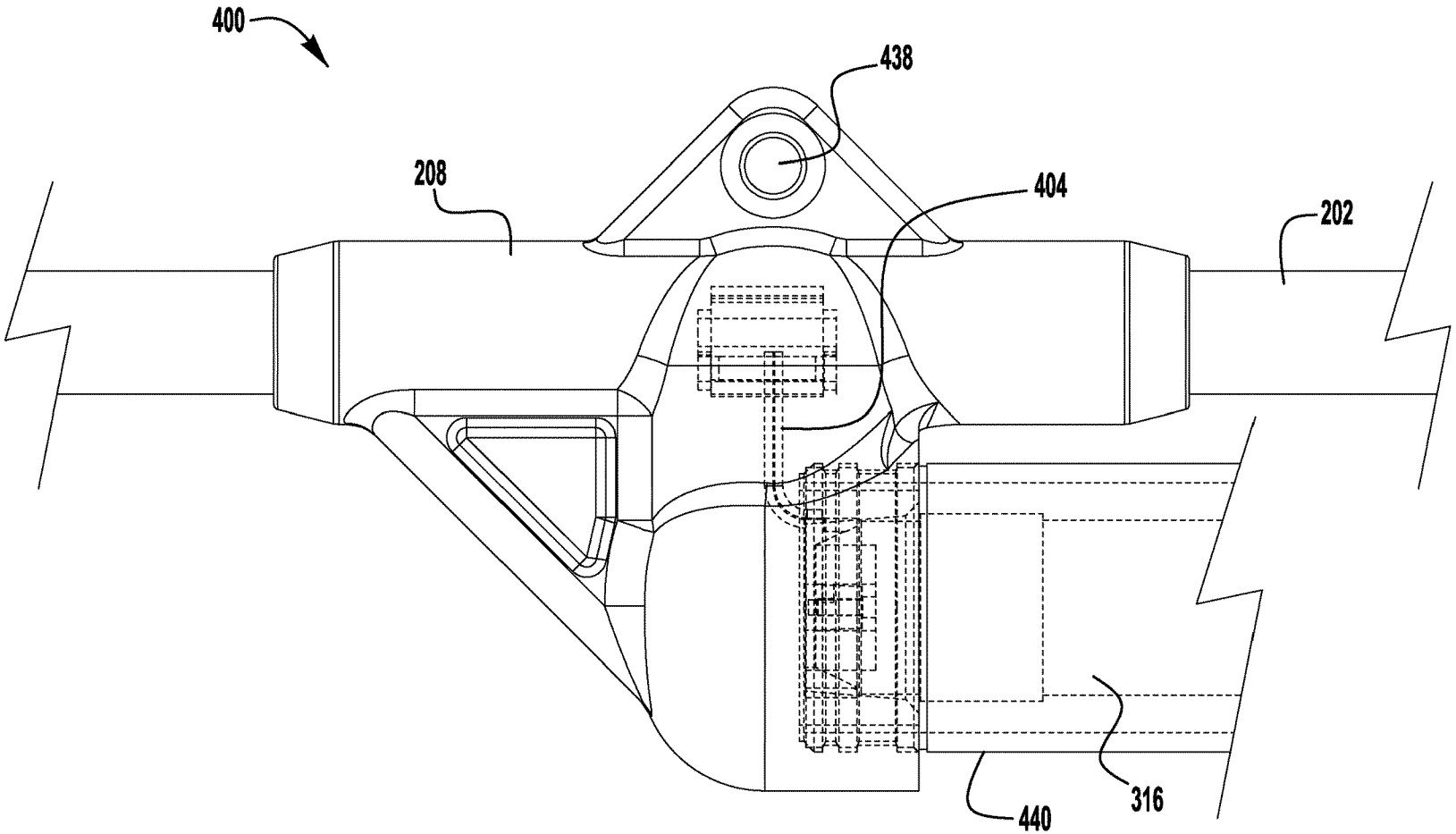
FIG. 4B is an illustration of the exemplary light fixture of FIG. 4A focused on a first cover, a socket, and a first end of an elongated LED lamp according to an embodiment of the present application.

FIG. 4B is an illustration of the exemplary light fixture 400 of FIG. 4A focused on the first cover 208, the socket 404, and the first end 534 (FIG. 5) of elongated LED lamp 316. The first cover 208 is secured to electrical cable 202 by through hole 526 (FIG. 5). The first cover 208 encases the socket 404 and has a first connection port 512 (FIG. 5) for receiving a first end 534 (FIG. 5) of the elongated LED lamp 316. The first end 534 of the elongated LED lamp 316 is connected to a socket 404 in the first connection port 512 of the first cover 208.

FIG. 5 is an exploded view of the exemplary lighting fixture 400 shown in FIGS. 4A and 4B including the elongated LED lamp 316. However, any type of electric lamp disclosed in the present application may be installed in light fixture 400. The socket 404 is secured along the electrical cable 202. In certain embodiments, the socket 404 is oriented in a substantially parallel position relative to the electrical cable 202, as shown in the illustrated embodiment. In one exemplary embodiment, the socket 404 is secured at predetermined position along the electrical cable 202. The first cover 208 encases the socket 404 and includes through hole 526, sloped surface 418, and the first connection port 512. The first cover 208 is secured along electrical cable 202 by through hole 526. In certain embodiments, the sloped surface 418 of the first cover 208 may extend inward toward the connection port 512 from a bottom surface of the portion of the first cover 208 having the through hole 526. The second cover 210 includes through hole 528, sloped surface 418, and the second connection port 514. The second cover 210 is secured along electrical cable 202 by through hole 528. In certain embodiments, the sloped surface 418 of the second cover 210 may extend inward toward the connection port 514 from a bottom surface of the portion of the second cover 210 having the through hole 528. The sloped surfaces 418 of the first cover 208 and the second cover 210 allows lighting device 200 to travel through an industrial or transportation setting, and specifically through small openings within a industrial or transportation setting, without getting snagged on objects, such as for example, walls or equipment. The first end 534 of the elongated LED lamp 316 is coupled to the socket 404 in the first connection port 512 of the first cover 208, and the second end 536 of the elongated LED lamp 316 is inserted in the second connection port 514 of second cover 210. When the elongated LED lamp 316 is installed in light fixture 400, the elongated LED lamp 316 is in a substantially parallel position relative to a horizontal axis 446 of the through hole 526 of the first cover 208, which reduces the height of the lighting device 200 and electric lamp combination in comparison to current lighting assemblies. This reduction in height allows the lighting device 200 to fit through small openings. In addition, the reduction in height of the lighting device 200 is preferable for rooms and areas that have low ceilings and smaller clearances.

In another exemplary embodiment, the lighting device 200 may include a length of electrical cable 202, a socket 404, and only a first cover 208. The lighting device 100 may have one or more sockets 404 and one or more first covers 208 secured along its length. The first cover 208 encases the socket 404. In addition, the first cover 108 has a first connection port 512 for receiving a first end 534 of an electric lamp 316. The first end 534 of the electric lamp 516 may be electrically coupled to the socket 404 in first connection port 512. In this embodiment, the second end 536 of the electric lamp 316 is not connected to a socket, and power is provided to the electric lamp 316 by only the socket 404 encased by the first cover 208.

Figure 6:
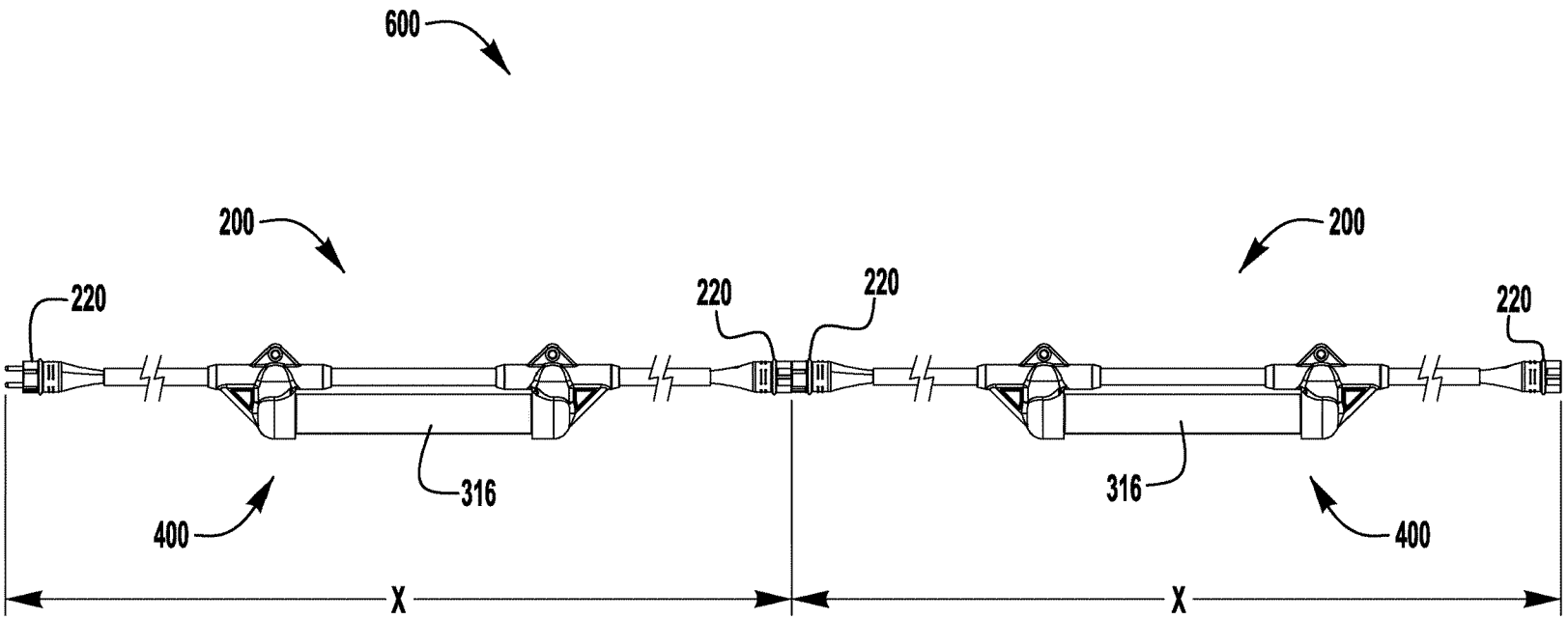
FIG. 6 is an exemplary lighting system including two of the lighting assemblies of FIG. 2 with electric lamps installed according to an embodiment of the present application.

FIG. 6 is an exemplary lighting assembly 600 including lighting devices 200. Each lighting device 200 of the lighting assembly 600 includes a light fixture 400 with an elongated LED lamp 316 installed. In some embodiments, the lighting assembly 600 only includes one lighting device 200. In other embodiments, the lighting assembly 600 includes two or more lighting devices 200. In certain embodiments, a lighting device 200 includes between about 1 light fixture 400 and about 400 light fixtures 400. A lighting device 200 may have a length X between about 6 feet and about 5000 feet. In certain embodiments, a lighting assembly 600 may include lighting devices 200 with different lengths. For example, a first lighting device 200 in a lighting assembly 600 may be about 50 feet and a second lighting device 200 in the lighting assembly 600 may be about 100 feet. The connections 220 of each lighting device 200 are configured so that lighting devices 200 may be connected to each other (i.e., the connections 220 include a plug and an outlet, and the plug of one lighting device 200 is connectable to the outlet of another lighting device 200). Thus, a lighting assembly 600 may be made as long as desired by connecting multiple lighting devices 200 together, which is desirable because industrial and transportation settings often have different lengths. In certain embodiments, a connection 220 of a lighting assembly can be electrically coupled to other electrically powered objects (e.g., power tools) such that the other electrically powered objects receive power when the lighting device 200 receives power. This is desirable because industrial and transportation settings often include various types of electrically powered objects, which means these settings need as many ways to power the electrically powered objects as possible.

A lighting device 200 may be installed in an industrial or transportation setting by pulling or feeding a lighting device 200 to a desired location. Additionally, one or more electric lamps 316 must be installed in the lighting device 200 either before or after pulling or feeding the lighting device 200 to the desired location. In addition, the lighting device 200 may be hung by placing a rope, wire, cable, or the like through hanger holes 438 (FIGS. 4A and 4B).

While various inventive aspects, concepts and features of the general inventive concepts are described and illustrated herein in the context of various exemplary embodiments, these various aspects, concepts and features may be used in many alternative embodiments, either individually or in various combinations and sub-combinations thereof.

Unless expressly excluded herein all such combinations and sub-combinations are intended to be within the scope of the general inventive concepts. Still further, while various alternative embodiments as to the various aspects, concepts and features of the inventions (such as alternative materials, structures, configurations, methods, circuits, devices and components, alternatives as to form, fit and function, and so on) may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the general inventive concepts even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

What is claimed is:

1. A lighting device comprising:

a length of electrical cable;

at least one socket secured to the electrical cable; and at least one cover configured to encase the socket; wherein the cover is secured to the electrical cable by placing the electrical cable in a through hole of the cover; and wherein the cover comprises a connection port configured to receive an end of an electric lamp and a closed end having a sloped surface that extends along a plane aligned with the connection port and a horizontal axis of the through hole, wherein the sloped surface facilitates travel of the lighting device in a direction of the horizontal axis.

2. The lighting device of claim 1 further comprising an electric lamp electrically coupled to the socket.

3. The lighting device of claim 2 wherein the electric lamp is an elongated LED lamp.

4. The lighting device of claim 2 further comprising at least one shield tube that encases the electric lamp, wherein the shield tube is disposed outside of the electrical cable and substantially parallel to the horizontal axis of the through hole.

5. The lighting device of claim 1 wherein an angle between the horizontal axis of the through hole and the sloped surface of the cover is between about 30 degrees and about 60 degrees.

6. The lighting device of claim 1 wherein an angle between the horizontal axis of the through hole and the sloped surface of the cover is about 43 degrees.

7. The lighting device of claim 1 wherein the at least one cover comprises a first cover and a second cover, wherein the first cover comprises a first connection port configured to receive a first end of an electric lamp, wherein the second cover comprises a second connection port configured to receive a second end of the electric lamp, and wherein at least the first cover encases a socket of the at least one socket.

8. The lighting device of claim 7 wherein both the first cover and the second cover are secured to the electrical cable by placing the electrical cable in the through hole of the cover.

9. The lighting device of claim 8 wherein both the first and second covers comprise a sloped surface that extends downward and inward along a plane aligned with the connection port and a horizontal axis of the through hole between the portion of the cover having the through hole and the connection port, and wherein an angle between a horizontal axis of the through hole and the sloped surface is between about 30 degrees and about 60 degrees.

10. The lighting device of claim 1 wherein the socket is oriented in a substantially parallel position relative to the horizontal axis of the electrical cable.

11. The lighting device of claim 10 wherein the socket is secured at a predetermined position along the electrical cable.

12. The lighting device of claim 1 wherein the cover comprises a plastic overmold shell.

13. A lighting device comprising:

a length of electrical cable;

at least one socket secured along the length of electrical cable; and at least one pair of covers, wherein each pair of covers comprises a first cover and a second cover;

wherein the length of electrical cable is placed in a first through hole of the first cover and a second through hole of the second cover so that the at least one pair of covers is secured to the length of electrical cable;

wherein the first cover encases a first socket of the at least one socket;

wherein the first cover comprises a first connection port configured to receive a first end of an electric lamp and the second cover comprises a second connection port configured to receive a second end of an electric lamp;

wherein the first cover and the second cover each comprise a closed end having a sloped surface that extends toward the other of the first and second covers, wherein the sloped surface facilitates travel of the lighting device in a direction of the length of the electrical cable.

14. The lighting device of claim 13 further comprising at least one electric lamp, wherein the electric lamp is electrically coupled to the socket.

15. The lighting device of claim 14 wherein the electric lamp is an elongated LED lamp.

16. The lighting device of claim 14 further comprising at least one shield tube that encases the electric lamp, wherein the shield tube is disposed outside of the electrical cable and substantially parallel to a horizontal axis of the first through hole.

17. The lighting device of claim 13 wherein an angle between a horizontal axis of the through hole and the sloped surface of the first cover is between about 30 degrees and about 60 degrees.

18. The lighting device of claim 13 wherein an angle between a horizontal axis of the through hole and the sloped surface of the first cover is about 43 degrees.

19. The lighting device of claim 13 wherein the socket is oriented in a substantially parallel position relative to a horizontal axis of the length of electrical cable.

20. The lighting device of claim 19 wherein the socket is secured at a predetermined position along the length of electrical cable.

21. The lighting device of claim 13 wherein the pair of covers comprise a hanger hole that permits the lighting device to be threaded along a cable.

22. A lighting device comprising:

a length of electrical cable;

at least one socket secured along the length of electrical cable;

at least one electric lamp comprising a first lamp that is operatively connected to a first socket of the at least one socket, wherein the first lamp is oriented in a substantially parallel position relative a horizontal axis of the length of electrical cable; and at least one shield tube comprising a first shield tube encases the first electric lamp; and at least one pair of plastic overmold shells comprising a first pair of plastic overmold shells that includes a first shell and a second shell;

wherein the length of electrical cable is placed in a first through hole of the first shell and a second through hole of the second shell so that the first pair of plastic overmold shells is secured to the length of electrical cable;

wherein the first shell encases the first socket;

wherein the first shell comprises a first connection port configured to receive a first end of the first electric lamp and a first end of the first shield tube, and the second shell comprises a second connection port configured to receive a second end of the first electric lamp and a second end of the first shield tube, such that electric lamp is entirely encased by the shield tube and the pair of plastic overmold shells.

23. The lighting device of claim 22 wherein the first shell and the second shell each comprise a closed end having a sloped surface that extends toward the other of the first and second shells.

24. The lighting device of claim 22 wherein the first lamp is an elongated LED lamp.

25. The lighting device of claim 22 wherein the first lamp is a non-standard electric lamp.

* * * * *